United States Patent [19]

Bucheit

[11] Patent Number: 4,467,957

[45] Date of Patent: Aug. 28, 1984

[54] FLUE FLOW REGULATOR

[76] Inventor: Frederick C. Bucheit, R.D. #1, Box 217, Beech Creek, Pa. 16822

[21] Appl. No.: 427,825

[22] Filed: Sep. 29, 1982

[51] Int. Cl.[3] ..... F23N 5/04

[52] U.S. Cl. ..... 236/96; 236/101 D

[58] Field of Search ..... 236/96, 101 D, 45, 1 G, 236/16, 19; 126/292

[56] References Cited

U.S. PATENT DOCUMENTS

| | | | |
|---|---|---|---|
| 388,250 | 8/1888 | Bohm | 236/101 D |
| 1,809,575 | 6/1931 | Sturgis . | |
| 2,020,882 | 11/1935 | Francis | 236/96 |
| 2,083,844 | 6/1937 | Hitchcock | 236/96 |
| 2,166,623 | 7/1939 | Chandler | 236/1 |
| 2,167,307 | 7/1939 | Monney | 236/96 X |
| 2,258,506 | 10/1941 | Fisher | 236/93 |
| 2,259,845 | 10/1941 | Valjean | 236/45 |
| 2,358,390 | 9/1944 | Field, Jr. | 236/45 |
| 2,371,512 | 3/1945 | Field, Jr. | 236/45 |
| 2,388,829 | 11/1945 | Cheasley | 236/96 X |
| 2,448,776 | 9/1948 | Crise | 177/311 |
| 2,496,410 | 2/1950 | Reil | 236/96 |
| 2,514,306 | 7/1950 | Biermann | 158/28 |
| 2,604,090 | 7/1952 | Martin | 126/290 |
| 2,687,256 | 8/1954 | Puffer | 236/96 |
| 2,742,231 | 4/1956 | Campbell | 236/45 |
| 3,889,653 | 6/1975 | Scogin | 126/110 |
| 4,088,113 | 5/1978 | McIntire et al. | 126/132 |

FOREIGN PATENT DOCUMENTS

| | | | |
|---|---|---|---|
| 965168 | 4/1948 | France | 236/96 |

*Primary Examiner*—William E. Tapolcai

*Attorney, Agent, or Firm*—Steele, Gould & Fried

[57] ABSTRACT

A temperature-dependent flow regulator for a combustion exhaust flue comprises a vent pipe connected to the flue by a first end, the opposite end having a movable valve member disposed therein, and thermostatic expansion means sensing the temperature of the flue, the expansion means being directly connected to the valve member via a linkage. The expansion means directly drives the valve member, independently of suction created by draft in the flue.

9 Claims, 7 Drawing Figures

FLUE FLOW REGULATOR

BACKGROUND OF THE INVENTION

1. Field of the Invention

This invention relates to the field of regulators for gaseous flow, and in particular flow regulators for solid fuel combustion devices such as wood stoves.

2. Description of the Prior Art

A number of devices have been conceived in which thermostats are connected in one manner or another to draft regulators on flues. Such devices have never become popular, and the usual flue is not equipped with any thermostatic member. The normal barometric or pressure-driven flue vent, having no thermostatic control, comprises a flapper member which is pivotally disposed at the mouth of the vent passageway, leading to the flue.

The connection between the combustion gas flue and the vent passageway is normally that of a "T", the vent tube meeting the flue at a right angle. Commonly, the vent is disposed horizontally and the flue vertically. The flapper valve for the vent is mounted across the vent opening to pivot upon a horizontally-disposed pivot bar. The pivot bar is usually located off-center, that is somewhat above the geometric midpoint of the flapper, whereby the flapper assumes a vertical position, completely blocking the flue vent, unless acted upon by air pressure.

Heated gases passing upwards through the flue create a pressure differential between the free air and the combustion exhaust at the inside of the flue, that is, a pressure differential across the flapper valve. The pressure differential opens the flapper valve, permitting free air to enter the flue through the vent passageway and to be carried along with the combustion gases. In theory, air from the vent satisfies momentary deficiencies in flow. The draft through the flue is thereby made less variable, allowing more dependable flow and more complete combustion of the fuel.

Several devices have been conceived which are intended to interface with such off-center balanced flapper valves. Such devices, for example, U.S. Pat. No. 2,401,553—Crew and 3,087,677—Patrick purport to allow the flapper valve to operate relatively freely, influenced, but not fully controlled, by a bimetallic thermostat member. Although such thermostatic control means may be useful for smoothing out variations in flue flow, thought necessary in the prior art, such devices fail to actually control the flow of gases in the flue. Rather, the flue vent is subject to the control of exhaust gases instead of the source of control therefor. Prior art flue vents are positioned by action of the draft in the flue. Thermostatic members may be included to influence flow, but the flap remains subject to flow in the flue, rather than vice-versa. Accordingly, the prior art fails to employ the flue vent to control the rate of combustion by controlling the egress of hot gases.

The present invention seeks to actually control the rate of combustion upstream of the flue by directly and rigidly controlling the passage of air through a flue vent equipped with a flapper valve member. The flapper valve of the invention is preferably mounted on a centered pivot, but may be conventionally mounted and balanced by an adjustable member. In any event, according to the invention variations in gas flow in the flue have little or no effect on the position of the flapper valve. The rate of exhaust flow does not control the flow of room air through the vent tube, and into the flue.

A bimetallic thermostat member is directly attached to the centrally pivoted flapper by means of a rigid linkage. The thermostat is preferably a coil of bimetallic material which expands when heated, forcing the vent flap closed or open as the flue is cooled or heated, respectively, by combustion gases.

The particular temperature at which the flap is positioned at a given angle may be initially adjusted and locked by means of a length-adjustable linkage member and/or, an indicator and scale arrangement may be included in the thermostat mounting, allowing the operating temperature to be set as desired at any particular time. The flap may also be locked shut in order to confine smoke while first lighting the stove, then allowed to open once a draft is established.

SUMMARY OF THE INVENTION

It is an object of this invention to safely control combustion by controlling the escape of exhaust gases from the area of combustion.

It is also an object of the invention to allow a user to fully load a fuel burning unit, fully open the air intake, and control the rate of combustion dependent upon the temperature of the exhaust.

It is also an object of the invention to control solid fuel burning stoves in the simplest and least expensive manner possible.

It is another object of the invention to drive a flue vent flapper valve in a manner entirely dependent upon temperature, and free of influences of pressure differentials.

It is yet another object of the invention to prevent the generation of flue-fouling hydrocarbon deposits by regulating combustion without starving the fuel burning area of supply air.

These and other objects are accomplished by a temperature-dependent flow regulator for a combustion exhaust flue, comprising a vent pipe connected to the flue, a first end of the vent pipe opening in the flue and an opposite end of the vent pipe opening in a free air space, a valve member mounted to at least partly block the vent pipe, the valve member being movable over a range of positions, the valve member adapted to more or less impede flow and to block flow in the vent pipe over the range, thermostatic expansion means sensing the temperature of the flue, and, a linkage directly connecting the expansion means to the valve member and operable to drive the valve member closed at a predetermined temperature of the flue, blocking flow in the vent pipe, and operable to position the valve member to progressively more closed positions at progressively lower temperatures of the flue.

BRIEF DESCRIPTION OF THE DRAWINGS

There are shown in the drawings the embodiments which are presently preferred. It should be understood, however, that the invention is not limited to the precise arrangements and instrumentalities depicted.

DETAILED DESCRIPTION OF THE PREFERRED EMBODIMENTS

Figure 1:
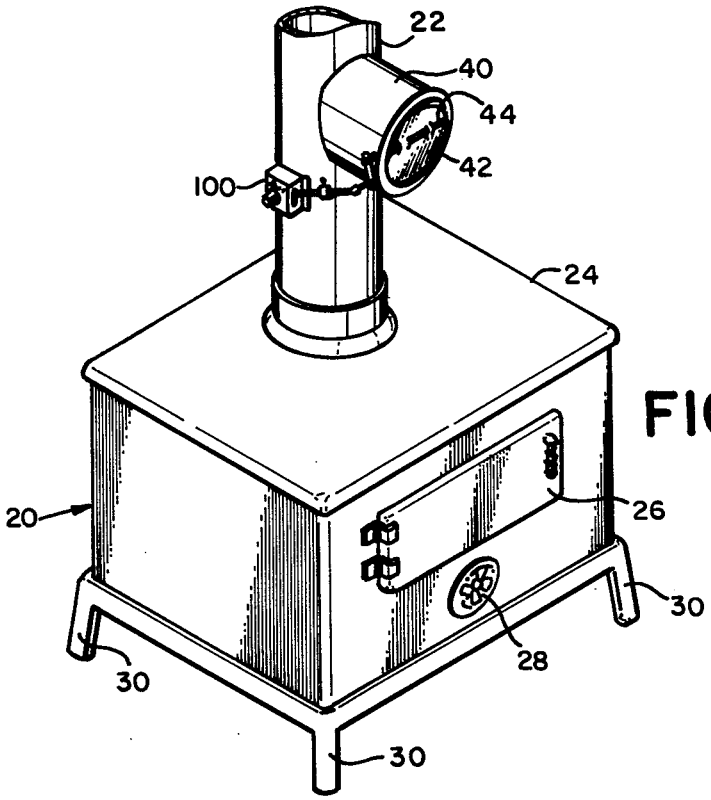
FIG. 1 is a perspective view of a combustion stove equipped with the device of the invention.

FIG. 1 illustrates a solid fuel burning stove, in perspective. In general, stove 20 comprises a body 24 into which fuel is placed to be burned. Such fuel may be wood, coal or any appropriate fuel. Solid fuel is placed in stove 20 by opening door 26, and placing the fuel upon fuel support members (not shown) which allow air to circulate around the fuel in order to burn freely.

Modern solid fuel burning devices are usually airtight, a controllable air input 28 being included in order to supply combustion air to the fuel carrying area. Although such air input devices are frequently embodied to be thermostatically controlled, the present invention precludes the necessity for such an elaborate air intake control which, by limiting the intake of oxygen, tends to generate undue amounts of unburned hydrocarbons which accumulate on various surfaces in the form of creosote. Accordingly, the present invention employs an open air intake or a simple slide control 28 which may be initially positioned and left at that position indefinitely.

The air intake 28, and/or the flue vent 40, may open into any appropriate open air space. The invention will be shown and described with reference to an air intake 28 and vent 40 which open in the space to be heated. It should be understood that maximum efficiency in a stove requires connecting these elements to a cold air space, for example air outside the heated area, in order to avoid waste of energy which occurs when warm air is drawn from the heated space and expelled through the flue.

The body 24 of stove 20 may become quite hot, dependent upon the extent of combustion taking place therein. The extent of combustion will be determined by the amount and character of fuel present, the availability of oxygen, and other factors. In order to avoid the necessity of frequent addition of fuel, it is preferable to load a full supply of fuel into the unit, for example all it will hold or enough to last through a winter night. It is therefore necessary to control combustion by some means other than controlling the amount of fuel present. Although it is convenient in oil or gas burning devices, as known in the art, to thermostatically control the supply of fuel, this is impractical in solid fuel burning devices because controllable fuel feeders operate dependably only with uniform shaped fuel pieces. Woodstones are especially unsuited for such control. Accordingly, some provision must be made to control combustion by controlling the supply of air.

One possible approach adopted by various designers is to control combustion by thermostatically controlling the air intake 28. It will be appreciated that the effect of closing air intake 28 is to starve the fire of oxygen. The fire must be first underway (with the intake wide open), eventually producing sufficient heat to operate the thermostatic valve. However, as the air intake thermostatically closes, insufficient oxygen is available in the fuel combustion area to supply the fire's demand and to completely combust the fuel. Combustion air control schemes which starve the fuel area of supply air are therefore prone to generate large quantities of smoke and unburned hydrocarbons which tend to condense on the cool surfaces of the stove in the form of creosote. Creosote is itself combustable, whereby accumulations in the flue and elsewhere eventually become thick enough to catch fire, often with catastrophic results.

The present invention takes a different approach in that rather than choking the fire by limiting the access of oxygen to the fuel combustion area, a draft regulator is employed on the flue and operated to displace flow of combustion gases in the flue. Since the rising exhaust gases are the driving force drawing oxygen to the fire, venting the exhaust path allows the force of suction to operate without drawing more air into the combustion area. Although the end effect is to limit the rate of combustion by limiting the oxygen available in the area of the fuel, the control is less drastic than prior art oxygen starvation methods which choke a burning fire. The invention does not deprive a fire of feed oxygen but instead affects the suction exerted on the fire by the flue. The result in a cleaner fire and less creosote.

With further reference to FIG. 1, a vent conduit 40 is attached to flue 22 and equipped with a thermostatically-controlled valve member 42. Devices having a flue vent and freely movable flapper valve are common. Unlike prior art devices, however, the present flapper valve is not freely driven by the pressure differential between the open air and the flue 22 due to combustion gases passing through the flue 22. Instead, the flapper valve is rigidly attached to a bimetallic expansion element 80 such that the flapper is driven open as the flue temperature increases, thereby limiting the flow of oxygen through the fuel area. As the temperature decreases, the flue vent is driven closed, whereby any suction developed by rising gases in the flue tends to draw air from the air intake, and not from the flue vent. In this manner the flue suction is used to fan the fire more as the fire cools, stabilizing the temperature.

Figure 2:
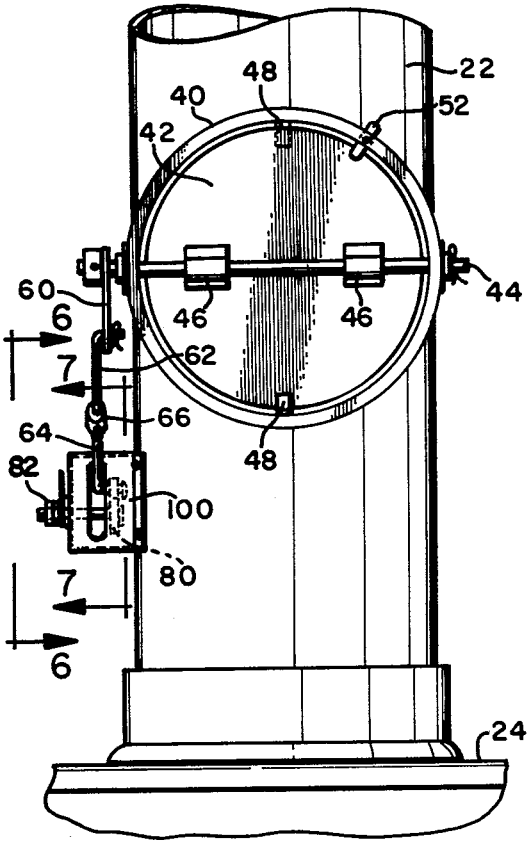
FIG. 2 is a front elevation view of the temperature-dependent flow regulator of the invention, the flapper thereof shown locked closed.
Figure 3:
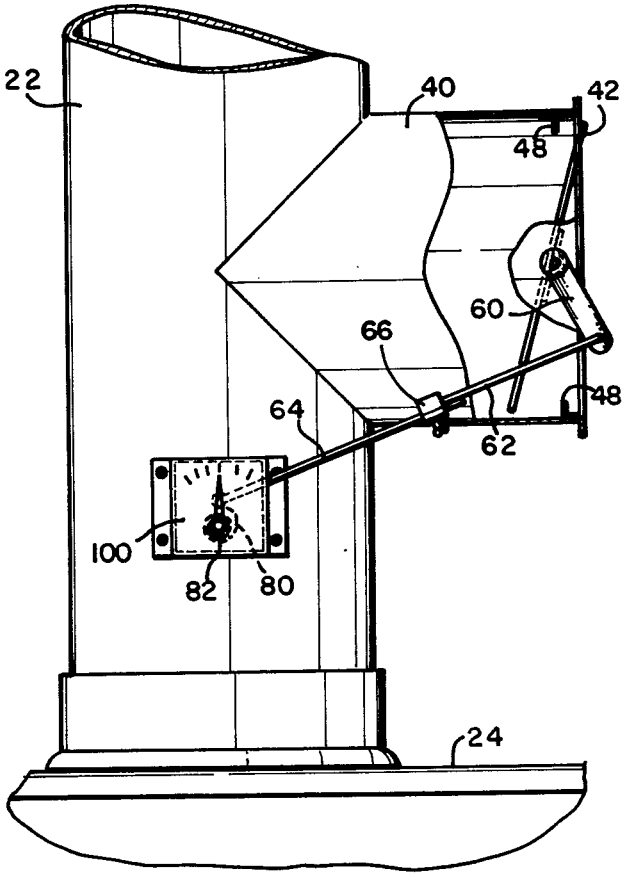
FIG. 3 is a side elevation view of the flow regulator in operation.

FIGS. 2-7 demonstrate the particulars of attachment of the preferred thermostatically operated devices of the invention. As shown in FIGS. 2 and 3, flapper member 42 is carried on bar 44, the flapper member being rigidly attached to bar 44 by tabs 46. Tabs 46, vent member 42 and bar 44 may be soldered, spot welded or otherwise rigidly connected to one another. Bar 44 is pivotally mounted horizontally, to cause flap 42 to open and close the vent as bar 44 is rotated. Stop members 48 prevent operation in both directions, tending to limit the range of flap 42 between horizontal and open in one way.

In order to disable thermostatic operation of the vent, locking means 52 may be included as shown in FIG. 2. Upon starting a fire, it is preferred that the vent be closed and locked, allowing time for smoke to clear the combustion area and some suction to be developed in the flue. This may be done by use of a lock member 52, pivotable around a mounting screw or rivet, and positionable to hold flap 42 in a closed position, against the force exerted by the thermostatic drive means 100. It will be incorporated at a number of positions around the flapper, the linkage or the thermostatic expansion means. Member 52 is shown as an example, in FIG. 2 only.

Flap 42 is rigidly attached to a lever arm 60, for example via bar 44. Lever arm 60 extends generally perpendicular to the axis of linkage bars 62, 64. Lever arm 60 is pivotally attached to linkage bar 62 which conveys the force of the bimetallic thermostat mounted in control 100. In particular, thermostat 80, carried on pivot 82 is attached to linkage arm 64, in turn attached to linkage arm 62 by length-adjusting lock member 66. It will be appreciated that the effect of the linkage and bimetallic coil is to position flap 42 open or closed based upon whether the temperature in the area of thermostat 80 is warm or cool, respectively.

When the stove is cool, flap 42 is held in its most closed position. Hot gases which rise in the flue tend to cause a suction which draws additional air in through air input 28, bootstrapping the rate of combustion. The hot gases, of course, heat the flue 22, gradually causing the expansion of bimetallic coil 80. The expanding coil positions flap 42 more near open. Preferably, a steady-state operation is assumed whereby an adequate rate of combustion is maintained while flap 42 is moderately open, providing a certain range of control.

Should no additional fuel be added, eventually the rate of combustion will decrease as the fuel is exhausted, thereby lowering the temperature of the flue and causing bimetallic thermostat 80 to contract. The contraction again closes the flapper vent and again allows the full suction of hot rising gases in the flue to operate to draw additional combustion air into the unit. The additional air increases the rate of combustion and increases the temperature, so long as the fuel lasts. Nevertheless, so long as fuel is available, the temperature of the stove is maintained as near as practicable to a control temperature, by varying the venting of the flue. The invention decreases flow when an increase in temperature is detected. Inasmuch as the full fuel supply is more-conveniently loaded into modern solid fuel units from the outset, constant temperature is needed rather than a constant rate of flow to reflect the fuel available.

Should the temperature of the stove exceed the maximum, flap 42 is forced as far open as possible, thereby cancelling the additional suction of rising gases in the flue. Accordingly, the stove does not run away, but returns to the desired temperature. By locating vent 40 near the combustion area, only a short length of flueway is provided in which suction develops, i.e., between the fire and vent 40.

The invention takes a fundamentally different approach to regulation of temperature, and to regulation of flow in a combustion flue, than that taken by previous thermostatically-controlled draft damping mechanisms. Previous draft dampers have been merely biased by a thermostatic control, being primarily driven by the pressure differential between the free air and the flow path in the flue. Such pressure differential is caused by the fact that moving air (e.g., in the flue) is at an effectively lower pressure than stationary air (e.g., in the open space). According to the usual draft damper, a steady state pressure differential caused by a uniform rate of flow causes the flapper valve to assume a certain partially-open position, and to remain there. As combustion momentarily increases or decreases, or an conditions change at the exit opening of the flue or chimney, the valve member is momentarily re-positioned, thereby maintaining a uniform flow rate insofar as this is possible. The invention, however, being driven by the thermostatically control and not by the pressure differential, employs a draft control which maintains a uniform temperature in the flue, and therefore in the combustion area, by regulating the exiting combustion gases. The inventor contributes to variations in flow in order to maintain constant temperature.

Figure 4:
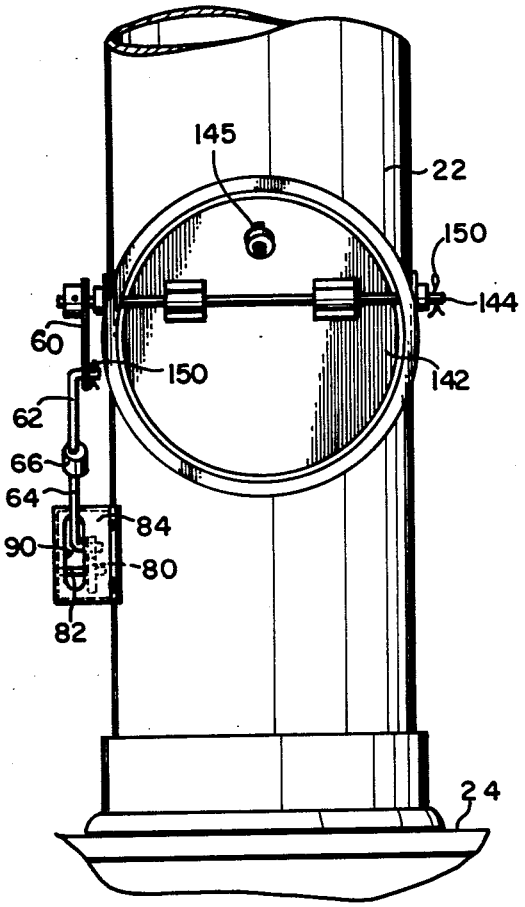
FIG. 4 is a front view showing an alternative embodiment of the invention.
Figure 5:
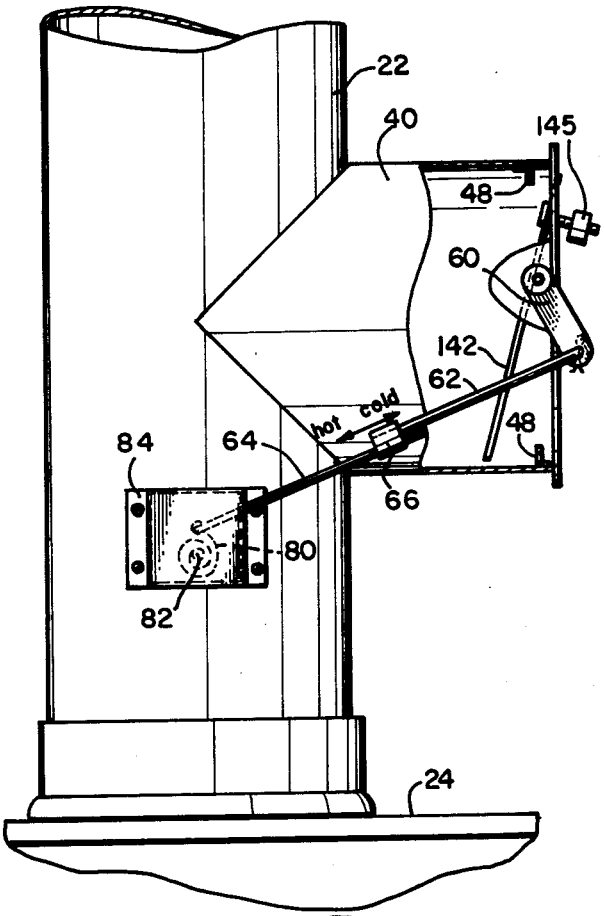
FIG. 5 is a side view of the embodiment of FIG. 4.

In order to control flap member 42 based only upon temperature rather than pressure difference, flap 42 is symmetrically pivoted. In other words, pivot 44 is mounted to precisely bisect flapper valve 42. Accordingly, air pressure applied to flap member 42 pushes equally above and below bar 44, and has no effect on the position assumed by the flapper. As shown in FIGS. 4 and 5, a hybrid device can incorporate the driving feature of the symmetrically-mounted flapper, and the prior art technique of barometrically regulating flow. With reference to FIGS. 4 and 5, pivot bar 144 is mounted off center, and precisely balanced by positioning weight 145 such that, regardless of the off center mount of pivot 144, flapper 142 is equally weighted both above and below the pivot. In the manner, the effect of gravity on the operation of the flapper, which would otherwise tend to maintain the heavier lower side of the flapper directly under the pivot (thereby closing the valve) is minimized. The effect of air pressure differentials, however, remains. An air pressure differential pressing against flapper 142 exerts greater pressure on the larger surface below bar 144. The pressure tends to move the flapper more nearly open or closed, depending on the direction of the pressure differential. The effect is not controlled entirely by such pressure differentials because bimetallic thermostat 80, connected by linkage member 64, 62, 60, resiliently biases flapper 142 to a position based upon the temperature in the area of the flue.

Figure 6:
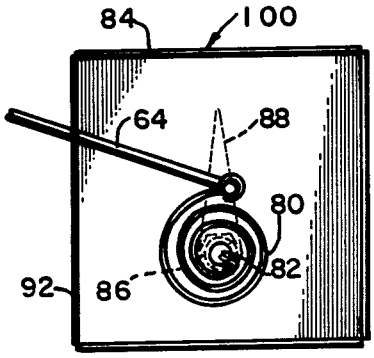
FIG. 6 is a section view taken along line 6—6 in FIG. 2.
Figure 7:
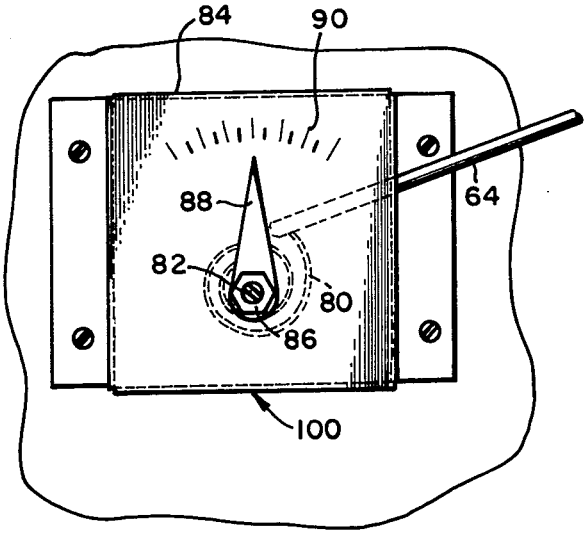
FIG. 7 is a partial section view taken along line 7—7 in FIG. 2.

Whether driven entirely thermostatically, or by a combination of air pressure and thermostatic forces, the temperature-dependent driving force is the same. As shown in FIGS. 6 and 7, bimetallic element 80, formed as a spiral, is mounted at pin 82 by a first (central) end, and to linkage member 64 at the opposite end, on the outer edge of the spiral. As known in the art, bimetallic member 80 comprises two layers of differing metals, having different coefficients of expansion. With changing temperature, spiral wound bimetallic element 80 tends to wind or unwind, exerting an axial force against linkage member 64. The axial force tends to close the vent when the area is cool, and open the vent when the area is hot.

The precise operation of the thermostatic control can be adjusted in various ways. The length of the linkage connecting bimetallic element 80 and lever arm 60 can be controlled by loosening attachment element 66 and adjusting the relative position of linkage element 62, 64. A similar effect can be achieved by adjusting the angular position of lever arm 60 with respect to the flap member, for example by a set screw attaching lever arm 60 and the pivot rod. These two types of adjustments are relatively-permanent and are suitable for initially adjusting the thermostatic control. If desired, an adjustment conveniently positionable by the user can be incorporated as well.

As shown in FIGS. 6 and 7, the mounting of thermoplastic element 80 can be included with a scale marking 90, indicator 88 attached to pin 82, and means for tensioning pin 82 at a certain angular position, for example, by means of nut 86. In use, the operator merely positions indicator 88 to the appropriate scale mark, thereby rotating bimetallic element 80 around pin 82, and thereby setting the basic position of the flap valve by means of linkage 64.

Bimetallic element 80 is preferably a heavyweight device, especially when used with an off center pivot, in order to drive the flapper member against the pressure differential, if any. With a centered pivot, a lighter weight thermostatic member may be used because the pressure acts equally on the flapper on both sides of the pivot, thereby cancelling the possible tendency to open or close the flap. Bimetallic member of suitable weight are commonly used in automobile choke thermostats. One possible thermostat is a spiral of springsteel and copper, approximately 2 mm thick and 10 cm long.

Use of a covering box member 84, enclosing thermostatic control 100, is preferred in order to confine the air space around bimetallic member 80, to most nearly reflect the temperature of the flue 22. Accordingly, a sheet metal covering box, attached for example by screws, surrounds the mounting of the bimetallic member, broken only by a slot 92 for passage of linkage member 64.

A number of variations may be employed in the mountings and connections of the members. Cotter pins, set screws and the like have been shown in the drawings as examples of possible connection members. It will be appreciated that various threadable connections, rivets and the like can be conveniently employed in placed of the foregoing elements. Further variations will now be apparent to persons of ordinary skill in the art, and reference should be made to the appended claims rather than the foregoing specification as indicating the true scope of the subject invention.

What is claimed is:

1. A temperature-dependent flow regulator for a combustion exhaust flue, comprising:

a vent pipe connected to the flue, one end of the vent pipe opening in the flue and the opposite end of the vent pipe opening in a free air space;

a valve member mounted in the vent pipe at a distance from the flue to effectively prevent contact between exhaust gases in the flue and the valve member, the valve member being movable over a range of positions from fully open to closed, to promote, retard and block air flow through the vent pipe and into the flue to control the rate of combustion;

thermostatic expansion means enclosed by a heat conductive cover, the cover being disposed exteriorly of and directly on the flue, the expansion means thereby accurately sensing the temperature of the exhaust gases in the flue; and, a rigid linkage extending through the cover, outside of the flue and of the vent pipe, and directly connecting the expansion means to the valve member and operable to drive the valve member closed at a predetermined low temperature of the exhaust gases in the flue, blocking flow in the vent pipe, and operable to position the valve member over the range of open positions at progressively higher temperatures of the exhaust gases in the flue, whereby combustion temperature is precisely controlled and all parts of the regulator are completely protected from exhaust gas damage.

2. The regulator of claim 1, wherein the valve member is an adjustably weighted flap, mounted to pivot on a support bar extending through the vent pipe, the support being disposed off-center of the flap, whereby suction generated in the flue applies a force to the flap tending to open the vent.

3. The regulator of claim 1, wherein the valve member is a flap mounted to pivot on a support bar extending through the vent pipe, the support being disposed to bisect the valve member, whereby the valve member is independent of suction in the flue.

4. The regulator of claim 1, wherein said linkage is adjustable in length.

5. The regulator of claim 1, wherein the expansion means is a bimetallic spiral, the spiral being fixed to a support at a first, central end thereof, an opposite end of the spiral being attached to the linkage.

6. The regulator of claim 5, further comprising means for manually rotating the support, thereby positioning the bimetallic expansion means over a range of positions.

7. The regulator of claim 3, wherein said linkage comprises a lever arm mounted to a valve member and a rod attaching the lever arm to the expansion means.

8. The regulator of claim 6, further comprising a scale indicator adapted to indicate the angular position of the expansion means.

9. The regulator of claim 1, further comprising a lock movably adapted to hold the valve member in closed position.

* * * * *